US005620070A

United States Patent [19]

Wang

[11] Patent Number: 5,620,070

[45] **Date of Patent: *Apr. 15, 1997**

[54] PULL HANDLE STRUCTURE FOR A TRUNK

[76] Inventor: Chien-Shan Wang, No.80, Tien Hsin Li, Yuan Li Chen, Miao-Li Hsien, Taiwan

[ * ] Notice: The term of this patent shall not extend beyond the expiration date of Pat. No. 5,458,020.

[21] Appl. No.: 555,705

[22] Filed: Nov. 14, 1995

[51] Int. Cl.[6] ..... A45C 13/26; B25G 1/04

[52] U.S. Cl. ..... 190/115; 190/39; 16/115; 280/655.1

[58] Field of Search ..... 16/115; 190/18 A, 190/39, 115; 280/37, 655, 655.1, 47.315

[56] References Cited

U.S. PATENT DOCUMENTS

| | | | |
|---|---|---|---|
| 4,523,773 | 6/1985 | Holtz | 280/655 X |
| 5,048,649 | 9/1991 | Carpenter et al. | 190/115 X |
| 5,257,800 | 11/1993 | Yang | 280/655 X |
| 5,379,486 | 1/1995 | Wang | 16/115 |
| 5,400,472 | 3/1995 | Chang | 16/115 |
| 5,458,020 | 10/1995 | Wang | 280/655 X |
| 5,459,908 | 10/1995 | Chen | 16/115 |
| 5,488,756 | 2/1996 | Hsieh | 190/115 X |

FOREIGN PATENT DOCUMENTS

| | | | |
|---|---|---|---|
| 4183672 | 6/1992 | Japan | 280/655 |

*Primary Examiner*—Sue A. Weaver
*Attorney, Agent, or Firm*—Bacon & Thomas

[57] ABSTRACT

An improved pull rod structure for use on a trunk is equipped with a pair of retaining posts each having a plurality of closely defined locking recesses. The retaining post is housed in an integrally formed side groove of an outer sleeve in which an inner tube having a latch assembly disposed in a tubular housing is secured to the bottom end. A spring biased latch fixed to the bottom end of a vertical driving linkage rod can be actuated to stick out of or retrieve a protrusion from an opening to selectively engage one of the locking recesses in a nearly stageless manner when a pivotal control member engaged with a handle of a trunk is pivoted or released.

1 Claim, 3 Drawing Sheets

PULL HANDLE STRUCTURE FOR A TRUNK

BACKGROUND OF THE INVENTION

The present invention relates to an improved pull handle structure for use on trunk, and particularly to a handle structure which can be extended and retrieved in adjustment of its length in a stageless manner and has a reinforced outer sleeve. A retaining post on which are closely disposed a plurality of locking recesses is housed in a side tubular groove of the outer sleeve. An inner tube having a latch assembly secured to the bottom thereof is slidably received inside the outer sleeve so that the inner tube can be slidably extended upwardly or retrieved downwardly with the latch means selectively engaged with on of the locking recesses of the retaining post whereby the pull handle of the trunk can be stagelessly adjusted.

A prior art pull handle for a trunk, published on a patent Gazette in Taiwan with a serial number 239270, was invented by the same applicant. Such pull handle can be adjusted to locate only at several positions. It is relatively inconvenient for a user to adjust such pull handle into an improper length, a little too short or too long. No miniature adjustment can be made in such case.

SUMMARY OF THE INVENTION

Therefore, the primary object of the present invention is to provide an improved pull handle for a trunk which can adjust its length in a stageless manner.

Another object of the present invention is to provide an improved pull handle for a trunk which has a pair of reinforced sleeves each having a retaining post housed therein.

DETAILED DESCRIPTION OF THE PREFERRED EMBODIMENTS

Figure 1:
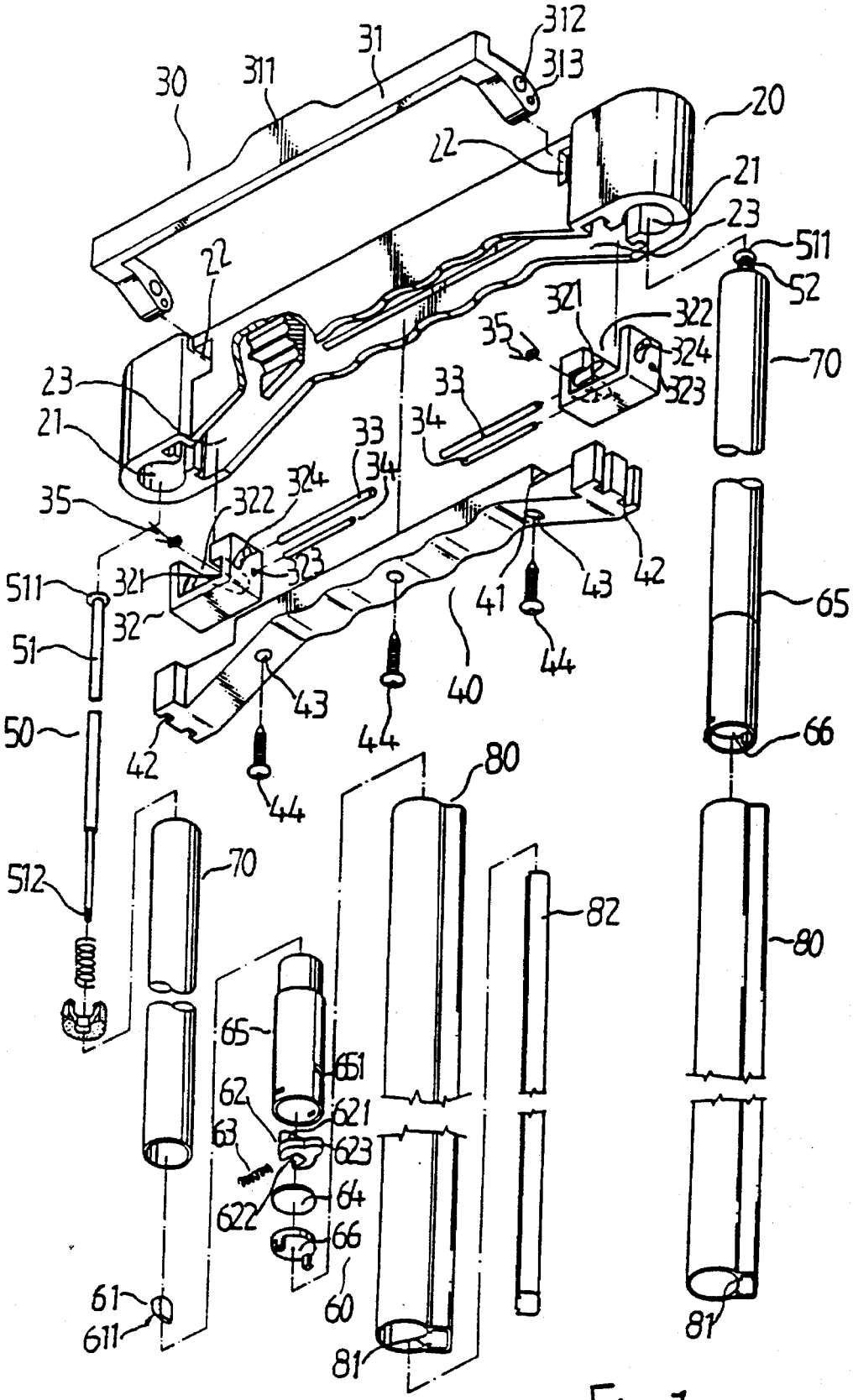
FIG. 1 is an exploded perspective view showing the components of the present invention.
Figure 2:
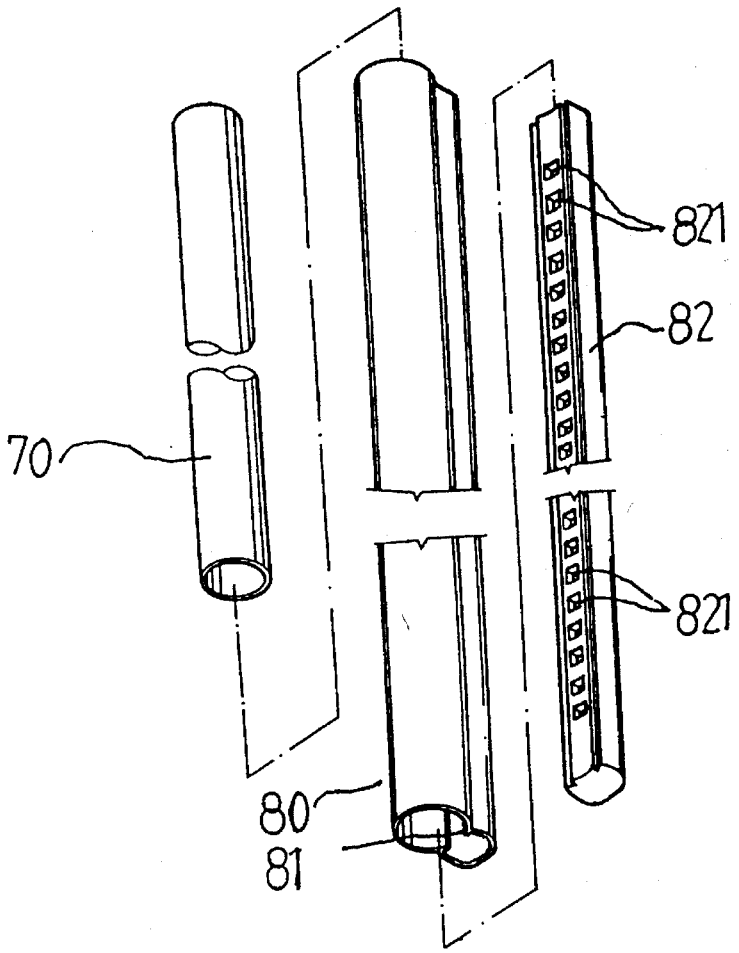
FIG. 2 is a partial, exploded perspective view showing the inner tube, the outer sleeve and the retaining post of the present invention.
Figure 3:
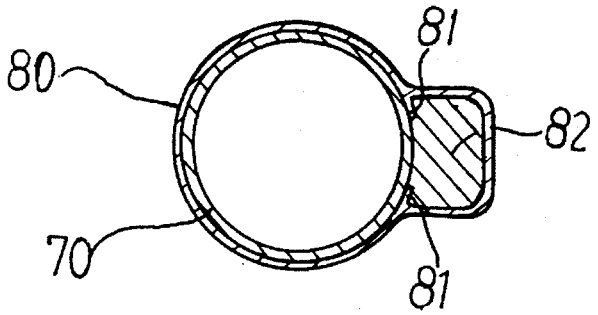
FIG. 3 is a cross-sectional view showing the assembly of the inner tube, outer sleeve and the retaining post shown in FIG. 2.

Referring to FIG. 1, the improved pull handle of the present invention is comprised of a handle portion 20, a spring biased control means 30 pivotally engaged with the handle portion, a lower lid 40 fixedly engaged with the handle portion 20, a pair of inner tubes 70, a pair of outer sleeves 80 in each of which one of the inner tubes 70 is slidably housed, a pair of driving linkage rods 50 each housed in each inner tube 70 and a pair of latch means 60.

The control means 30 is made up of a pivotal actuation member 31 having a bulge portion 311 and a pair of engagement holes 312, 313 at each end thereof for the location of a first and second driving rod 33, 34 respectively.

The lower lid 40 has a number of screw holes 43 and is secured to the handle portion 20 by screws 44. At each end of the lower lid 40 is disposed a receiving cavity 41 for mounting of a guide block 32. Each end of the lid 40 is also provided with a pair of notches 42 so that the lid 40 can be engaged with the handle portion 20.

Each latch means 60 has a push block 61 with tapered surface 611 secured to the bottom end 512 of each said driving linkage rod 50. A spring 63 in notch 622 biases latch 62 which is slidably supported by a disc plate 64 disposed on top of a bottom lid 66 removably secured to one end of each tubular housing 65 having an opening 651 for the sticking out of the latch 62. The latch 62 has a tapered surface 621, a retaining protrusion 623 and is retracted against the bias of spring 63 when the push block 61 is actuated by the operation of the control means 30.

The tubular housing 65 is secured to the bottom end of each said inner tube 70, as shown in FIG. 1. The driving linkage rod 50 has a flat abutment head 511 at the top end of upper portion 51.

Referring to FIG. 1, a pair of the guide blocks 32 are housed in the handle portion 20. Each guide block 32 has curved guide slots 324 in which a horizontally disposed first driving rod 33 is movably confined.

The handle portion 20 is provided with a cylindrical hole 21 at each end thereof so as to receive the inner tube 70, and a central groove 23 for housing the guide blocks and the first and second driving rods 33, 34.

Figure 4:
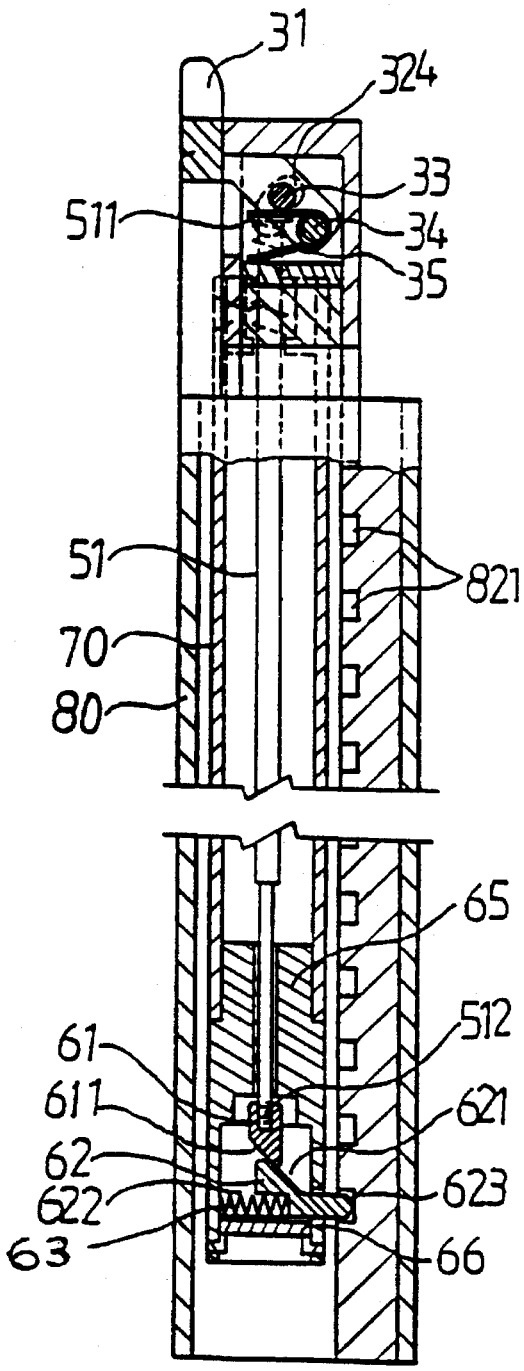
FIG. 4 is a cross-sectional view showing the retaining post being locked in place.
Figure 5:
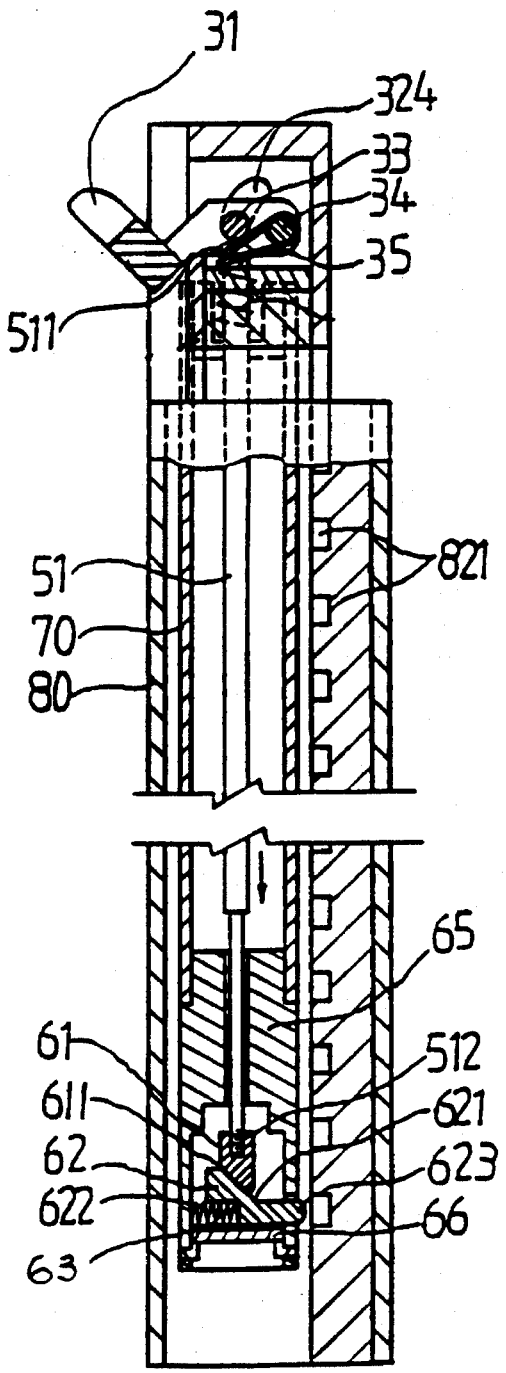
FIG. 5 is a cross-sectional view showing the inner tube being disengaged from the retaining post and free to move.

One end of the driving rod 33 biased by the springs 35 extends out of each guide block 32 via the guide slots 324 and is in abutment with the flat abutment head 511 of the driving linkage rod 50, as shown in FIGS. 4, 5. The pivotal control means 30 has two ends each of which is fixedly engaged with the horizontal first driving rod 33 and is pivotally housed in a hole 22 defined at each end of the handle portion 20 and is further movably engaged with one of the guide blocks 32 with the horizontally disposed first driving rod 33 led through the curved guide slots 324 and one hole disposed at one end of the control means 30.

The second driving rod 34 having each end engaged with a bias spring 35 housed in a V-shaped cavity 321 of the guide block 32 is led through the holes 323 defined on the guide block 32 so that the first driving rod 33 can be retractably actuated. Each guide block 32 has a receiving cavity 322 for housing one end of the actuation member 31. The guide blocks 32 are supported in place by the lower lid 40.

The present invention is characterized by that each outer sleeve 80 has an integrally formed side groove 81 extending the full length of the sleeve 80 in which a retaining post 82 having a plurality of closely spaced locking recesses 821 defined thereon is housed whereby the latch 62 of each latch means 60 sticking out of the opening 651 of the tubular housing 65 can be selectively engaged with one of the closely spaced locking recesses 821 when the inner tube 70 is vertically adjusted in operation for varying the length of the pull rod of the trunk.

I claim:

1. An improved pull handle for a trunk comprising:

a handle portion;

a spring biased control means pivotally engaged with said handle portion;

a lower lid fixedly engaged with said handle portion;

first and second inner tubes attached to and extending from the handle portion;

a pair of outer sleeves in each of which one of said inner tubes is slidably housed;

first and second driving linkage rods, one housed in each of said first and second inner tubes;

first and second latch means one latch means located in each of said first and second inner tubes, each latch means having a tapered push block secured to a bottom end of one of said first and second driving linkage rods, a latch slidably supported by a disc plate disposed in a bottom end of each inner tube, the latch having a protrusion thereon, the latch being movable between an extended position wherein the protrusion extends exteriorly of the inner tube and a retracted position wherein the protrusion is located within the inner tube, and a spring acting on the latch so as to bias the latch toward the extended position;

said driving linkage rods each having a flat abutment head at a top end thereof;

first and second guide blocks housed in said handle portion, each of said guide blocks having a curved guide slot in which a horizontally disposed driving rod is movably located, one end of said driving rod extending out of said guide block and being in abutment with said flat abutment head of one of said first and second driving linkage rods;

said spring biased control means having two ends each of which is fixedly engaged with one of said horizontal driving rods and is pivotally attached to said handle portion and said guide blocks such that pivoting movement of said control means relative to said guide blocks causes said driving rods to move along said curved guide slot and move said driving linkage rods which, in turn, causes the latch means to move between its extended and retracted positions;

each of said outer sleeves having an integrally formed side groove extending the full length of said outer sleeves in which a retaining post having a plurality a closely spaced locking recesses is housed whereby said protrusions of each of said latch means sticking out of said inner tubes engages one of said closely spaced locking recesses for varying the length of said pull handle of a trunk.

* * * * *